US005469348A

United States Patent [19]

Wong

[11] Patent Number: 5,469,348

[45] Date of Patent: Nov. 21, 1995

[54] SUPPORT FOR A LIGHT TUBE AND METHOD OF USE

[76] Inventor: Yin H. Wong, 158 Jalan Dato Sulaiman, Century Garden, Post Code 80250, Johor Bahru, Malaysia

[21] Appl. No.: 241,591

[22] Filed: May 12, 1994

[30] Foreign Application Priority Data

Nov. 22, 1993 [GB] United Kingdom ..... 9323958

[51] Int. Cl.[6] ..... F21S 3/00

[52] U.S. Cl. ..... 362/217; 362/147; 362/368; 439/239

[58] Field of Search ..... 362/260, 147, 362/217, 368, 145, 457; 439/232, 239

[56] References Cited

U.S. PATENT DOCUMENTS

| | | | |
|---|---|---|---|
| 2,402,941 | 7/1946 | Bixby | 439/239 |
| 2,511,155 | 6/1950 | Gaynor | 362/217 |
| 2,519,636 | 8/1950 | Curzon | 362/217 |
| 3,052,864 | 9/1962 | Gaynor | 439/239 |
| 3,723,945 | 3/1973 | Detch | 362/217 |
| 3,828,299 | 8/1974 | Johnson | 439/239 |
| 4,907,138 | 3/1990 | Brueggemann et al. | 362/217 |

FOREIGN PATENT DOCUMENTS

| | | | |
|---|---|---|---|
| 329936 | 8/1989 | European Pat. Off. . | |
| 252917 | 10/1948 | Switzerland | 439/239 |

*Primary Examiner*—James C. Yeung
*Attorney, Agent, or Firm*—Cushman, Darby & Cushman

[57] ABSTRACT

A support 11 for an elongate fluorescent light tube 12 having at each end a pair of projecting electrical contact pins 13, comprises an elongate casing 14 and first and second holders 15 and 16 depending from the frame at respective ends thereof. Each holder has a holding structure 18 which defines upwardly facing openings 19 and 20 for receiving the contact pins 13 of the light tube, to contact electrical terminals 21 and 22 located in the openings. Each holder is shaped to define an entry space 60 between the entrance to the openings 19 and 20 and the casing 14, whereby the light tube can be installed in the support by sideways movement of the pins 13 into the entry space, followed by downward movement of the pins into the respective openings 19 and 20. Support surfaces 26 are formed on the holding structure 18 to support the light tube temporarily by the pins thereof during installation before contact is made by the pins with the electrical terminals.

5 Claims, 4 Drawing Sheets

SUPPORT FOR A LIGHT TUBE AND METHOD OF USE

The present invention relates to a support for a light tube, and a method of installing a light tube in such a support.

An elongate fluorescent light tube is normally supported by a holder at each end of an elongate frame provided by an elongate casing in which are mounted the wiring and starter for the light tube. The holders are positioned one at each end of the casing and depend downwardly from the casing. The casing is usually fastened to the ceiling or other overhead support. Each holder includes electrical terminals for contacting electrical contact pins which project from each end of the fluorescent light tube.

In known arrangements, the fitting of a light tube to such a support is an awkward matter because the tube has to be held, often above the head of the operator, and has to be manoeuvred into a clamped position where the pins of the light tube contact the terminals of the holders. In one common arrangement the contact pins of the light tube are pushed from the bottom of the holder in an upward direction into slots in the holder. The light tube is then rotated so that each pin is in contact with an electrical terminal of the holder, to complete the electrical circuit.

It is an object of the present invention to provide a support for an elongate fluorescent light tube which makes easier and more convenient the task of installing a light tube. It is also an object to provide an easier and more convenient method of installing a fluorescent light tube.

According to the present invention there is provided a support for an elongate light tube having at each end a pair of projecting electrical contact pins, the support comprising: an elongate frame; first and second holders depending from the frame and spaced apart along the frame; each holder having a holding structure which defines upwardly facing openings for receiving the contact pins of the light tube, each holder having electrical terminals located respectively in the region of the openings for contacting the pins of the light tube.

Preferably each holder includes support means adapted to support the light tube temporarily by the pins thereof during installation before contact is made by the pins with the electrical terminals. Conveniently the support means of each holder comprises at least one support surface formed on the holding structure of the holder.

Preferably each holder is shaped to define an entry space between the entrance to the openings and the elongate frame, whereby the light tube can be installed in the support by sideways movement of the pins into the respective entry space, followed by downward movement of the pins into the respective openings.

Preferably the upwardly facing openings defined by the holding structure are tapered over at least part of their length, with the width of the opening decreasing in a downward direction, and conveniently each said electrical terminal comprises a generally U-shaped spring member positioned in a respective one of the said upwardly facing openings with the open end of the U aligned with the entrance to the opening so as to receive in the U-shaped spring member a contact pin pushed downwardly into the said opening.

In one preferred form of the invention, each holder is positioned at a respective end of the elongate frame, each said holding structure comprising a first body extending downwardly from the elongate frame, and a second body which is spaced from the frame and projects from the first body in an inward direction generally along the direction of the elongate frame and away from the said end of the elongate frame, the second body having an upper face which faces towards the underside of the elongate frame, and the upwardly facing openings being formed in the upper face of the second body. It may be arranged that the second body has an inward face which faces in the said inward direction, the said openings comprising slots extending downwardly in the second body, the slots extending also in the said inward direction to open also at the inward face of the second body, whereby the terminals can be inserted into the openings through the said inward face of the second body, each holder including a removable cover positioned across the said inward face of the second body, the removable cover including slots corresponding to the slots in the second body to allow movement of the pins of the fluorescent tube into contact with the U-shaped spring terminals. The holding structure may include a third body positioned at a distal end of the second body and projecting from the said inward face of the second body in the said inward direction, the third body being a curved arcuate body forming a cap for concealing the end of a light tube mounted on the support.

It is to be appreciated that where features of the invention are set out herein with regard to apparatus according to the invention, such features may also be provided with regard to a method according to the invention, and vice versa.

In particular, there is provided in accordance with the invention a method of installing an elongate light tube having at each end a pair of projecting electrical contact pins, in a support comprising an elongate frame, first and second holders depending from the frame and spaced apart along the frame, each holder having a holding structure which defines upwardly facing openings for receiving the contact pins of the light tube, and each holder having electrical terminals located in the region of the openings for contacting the pins of the fluorescent tube, each holder being shaped to define an entry space between the entrance to the openings and the elongate frame, and each holder including a support surface means; the method including the steps of: moving the elongate light tube in a sideways movement transverse to the length of the elongate frame, so as to move the contact pins of the light tube into the said entry space defined between the entrance to the openings and elongate frame; resting the light tube by placing the contact pins thereof on the said support surface means to support the tube temporarily by the pins thereof before contact is made by the pins with the electrical terminals; aligning the contact pins with the openings; and moving the light tube downwardly so as to produce downward movement of the pins into the said openings until the pins make electrical contact with said electrical terminals of the holders.

An embodiment of the invention will now be described by way of example with reference to the accompanying drawings in which.

Figure 1:
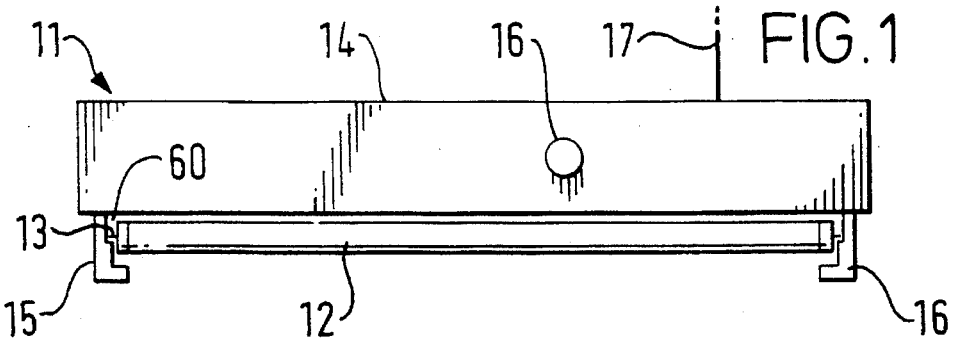
FIG. 1 is a diagrammatic side view of a fluorescent light tube at an intermediate stage when being installed in a support embodying the invention.
Figure 2:
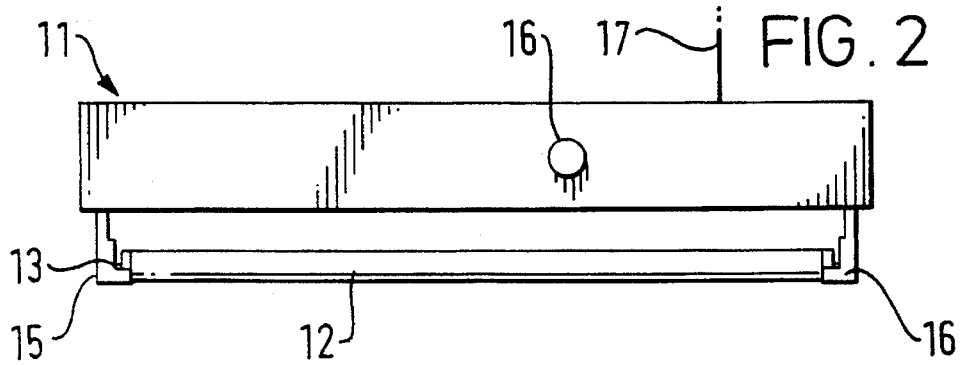
FIG. 2 is a diagrammatic side view of the support shown in FIG. 1, after the light tube has been fully installed.
Figure 3:
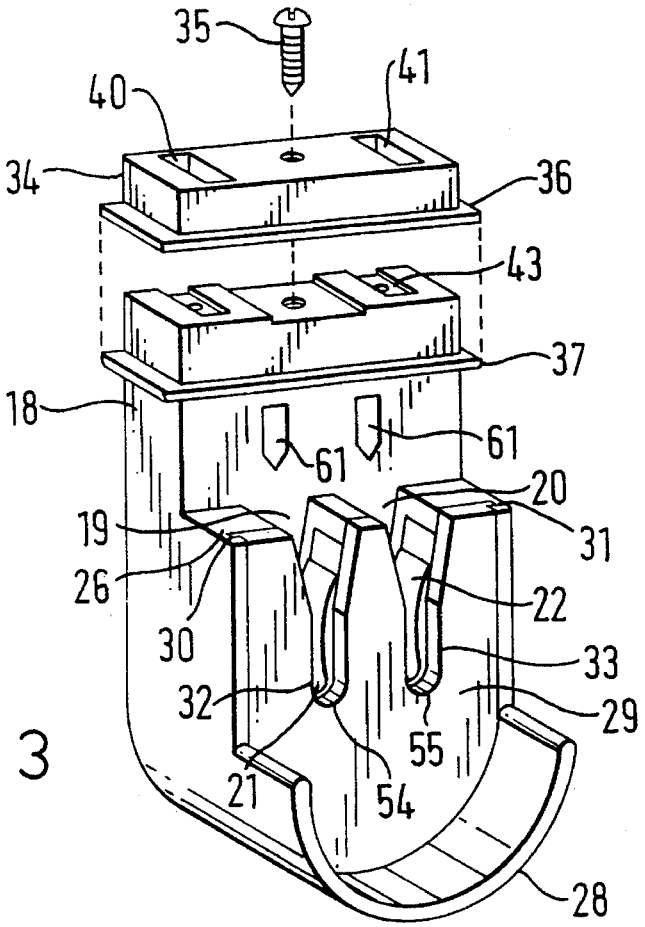
FIG. 3 is a diagrammatic perspective view of a holder embodying the invention, forming part of the support shown in FIGS. 1 and 2.

Referring first to FIGS. 1, 2 and 3, a support 11 for an elongate fluorescent light tube 12 having at each end a pair of projecting electrical contact pins 13, comprises an elongate frame formed by a metal casing 14, and first and second holders 15 and 16 depending from the casing and positioned one at each end of the casing 14. The casing 14 includes wiring for the fluorescent tube 12 and a starter 16 for the tube. The casing 14 may be secured to a ceiling or like structure, and is fed with current through a cable 17. FIG. 2 shows the light tube 12 fully installed and FIG. 1 shows the tube 12 partly installed, as will be described hereinafter.

Referring to FIG. 3, the holder 15 will be described, the holder 16 being of similar construction. The holder 15 has a holding structure 18 which defines two upwardly facing elongate openings 19 and 20 for receiving the contact pins 13 of the light tube. Electrical terminals 21 and 22 are located respectively in the openings 19 and 20 for contacting the pins 13 of the fluorescent tube 12.

Figure 6:
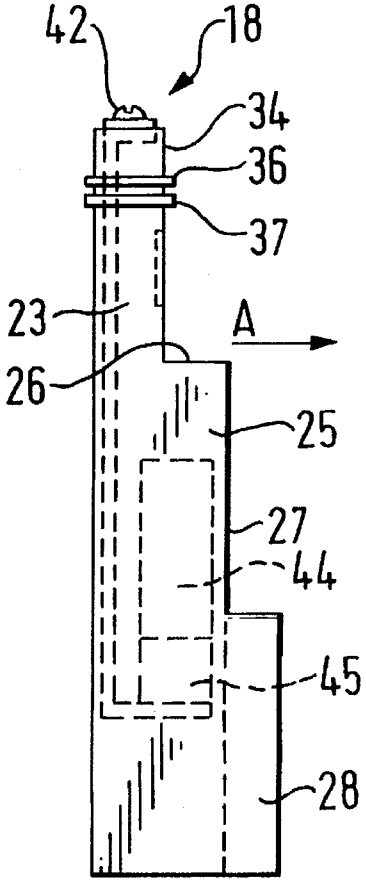
FIGS. 5 and 6 are end and side views respectively of the holder shown in FIG. 3.
Figure 5:
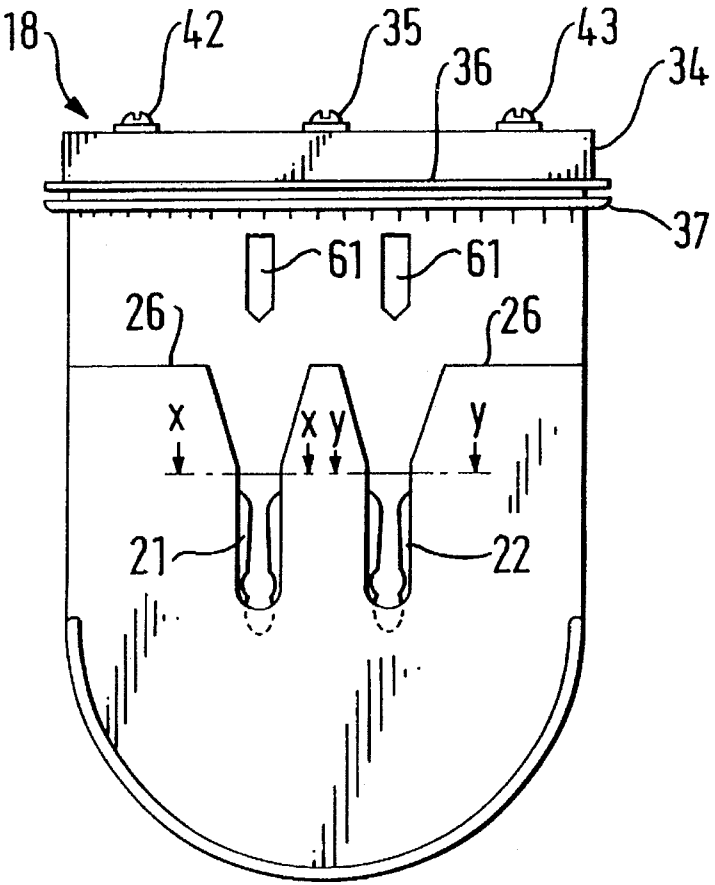

Referring to FIGS. 5 and 6, the holding structure 18 comprises a first body 23 shown in FIG. 6 as extending the full height of the holding structure 18. The holding structure 18 also comprises a second body 25 which is spaced from the casing 14 and projects from the first body 23 in an inward direction generally along the direction of the elongate casing 14 and away from the end of the casing at which the holder 15 is situated. The inward direction is indicated by the arrow A in FIG. 6. The second body 25 has an upper face 26 which faces towards the underside of the elongate casing 14. The said upwardly facing openings 19 and 20 are formed in the upper face 26 of the second body 25. The second body 25 has an inward face 27 which faces in the said inward direction A, the openings 19 and 20 comprising slots extending downwardly into the second body 25 and also extending in the said inward direction A to open also at the said inward face 27 of the second body 25.

The holding structure 18 also comprises a third body 28 positioned at the bottom of the second body 25 and projecting from the inward face 27 of the second body in the said inward direction A. The third body 28 is a curved arcuate body forming a cap for concealing the end of a light tube mounted in the holder 15.

Figure 4:
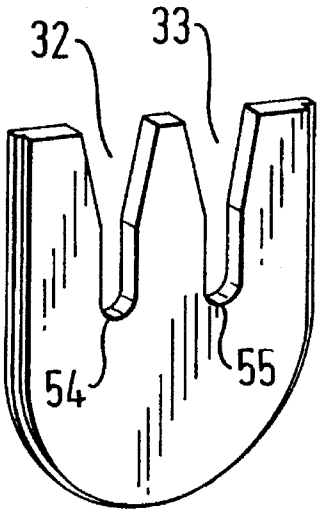
FIG. 4 is a diagrammatic perspective view of a removal cover shown in place in the holder of FIG. 3.
Figure 7:
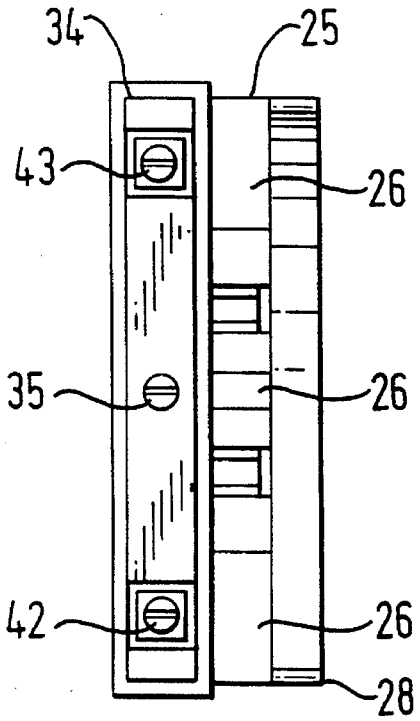
FIG. 7 is a plan view from above of the holder shown in FIG. 5.
Figure 8:
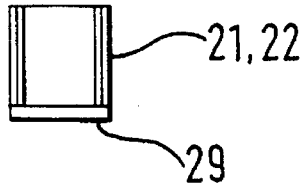
FIG. 8 is a diagrammatic cross section along the lines x—x or y—y in FIG. 5.
Figure 9:
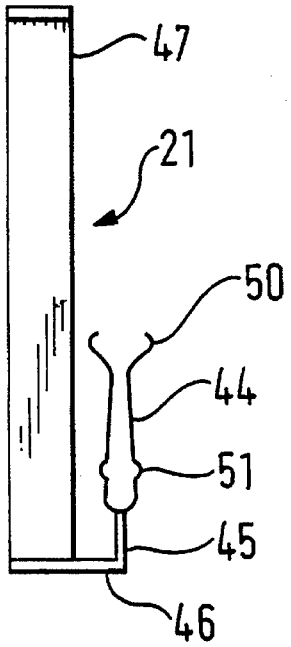
FIGS. 9, 10 and 11 are end, side and plan views respectively of an electrical terminal unit forming a component of the holder shown in the preceding figures.
Figure 10:
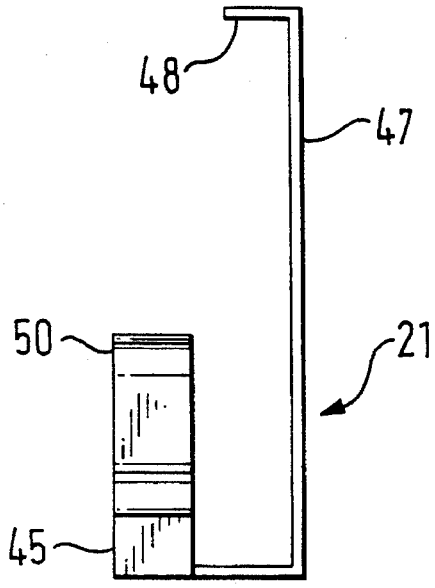
Figure 11:
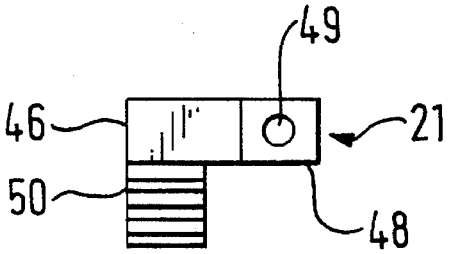

In the preferred form shown in the drawings, the three bodies 23, 25 and 28 of the holding structure 18 are formed integrally as a single structure of plastics material. As shown in FIG. 3, a removable cover 29 (shown in detail in FIG. 4) is secured in grooves 30 and 31 formed in distal edges of the second body 25. The cover 29 is removable by sliding movement upwardly along the grooves 30 and 31. The removable cover 29 has slots 32 and 33 which correspond generally to the openings 19 and 20 in the second body 25, but which are slightly shorter than the openings 19 and 20.

As shown in FIGS. 3, 5, 6 and 7, a metal cover 34 fits over the top of the first body 23 and is securable by a screw 35. At the lower edge of the cover 34 is a outstanding flange 36, and a corresponding flange 37 is provided on the first body 23 at a position slightly spaced from the flange 36 when the screw 35 is screwed home. When the holder 15 is secured to the elongate casing 14 as shown in FIG. 2, the upper part of the first body 23 projects through an opening (not shown) in the base of the casing 14, and the holder 15 is securely clamped to the underside of the casing 14. This clamping is achieved by the lower face of the casing 14 being clamped between the two flanges 36 and 37 around the edge of the opening at which the upper part of the first body 23 projects into the casing 14. The metal cover 34 has two rectangular openings 40 and 41 through which access can be gained to screw terminals 42 and 43 for connection to the power supply of the lamp.

Referring now to FIGS. 9, 10, 11 and 12, the electric terminal 21 comprises a generally U-shaped spring member 44 secured on top of a metal stem 45 which is connected in turn to a flat metal strip 46 which leads horizontally to an upright metal strip 47 leading up to the screw terminal 12 at the top of the first body 23. At the top of the upright strip 47, a further short horizontal strip 48 extends forwardly and has a hole 49 to accommodate the screw terminal 42. The electrical terminal unit shown in FIG. 9 may conveniently been made of copper or copper alloy. The U-shaped spring member 44 has a funnel shaped portion 50 at the top to facilitate the downward movement of the contact pins into the spring member. Toward the base of the spring member 44 two part circular portions at 51 are provided to grip a contact pin of a fluorescent lamp when pushed into the spring member. The distance between the portion 50 and 51 in FIG. 9 has been exaggerated to reveal the design of the spring system in detail.

Figure 12:
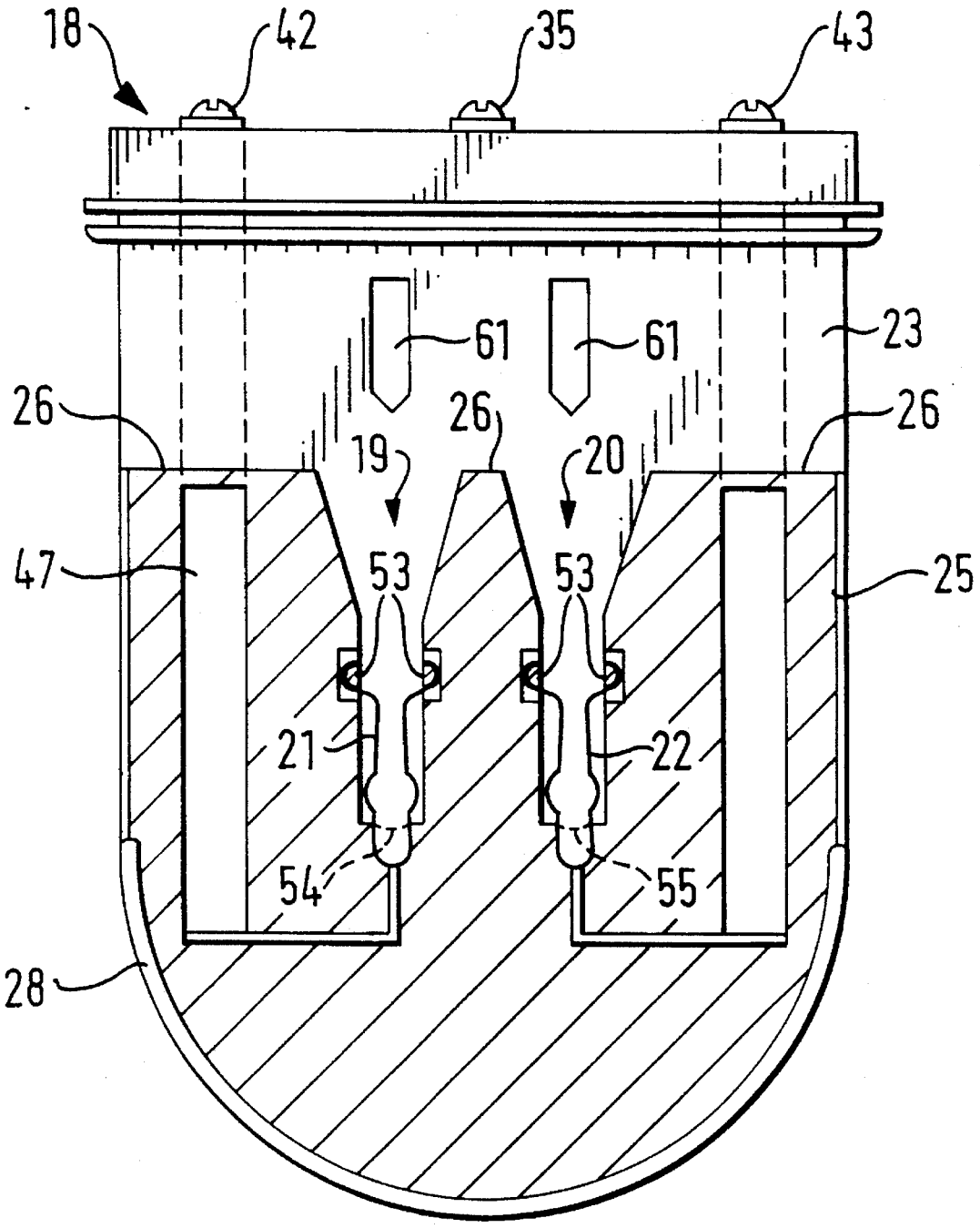
FIG. 12 is an end view of the holder shown in FIG. 3, showing the unit diagrammatically partly in cross section and partly with components cut away.

In FIG. 12, the spring members 21 and 22 are shown installed in the openings 19 and 20 in the second body 25. The spring members 21 and 22 are fitted in place by removing the cover 29 (FIG. 3) and then sliding the spring members 21 and 22 into shaped portions of the openings 19 and 20. Retaining studs 53 are formed on the second body 25 and cooperate with curved portions of the funnel shaped region 50 of the spring member 21, to retain the spring member 21 in place in the opening 19. As shown in FIG. 12, as the spring member 21 is inserted in the opening 19, the upright flat metal piece 47 is pushed upwardly through a flat channel with a rectangular cross section in the first body 23. After the spring member 44 has been installed, the upper part of the flat metal strip 47 is bent over at 48 at a right angle to allow the screw 42 to be installed. The spring member 22 is identical to the member 21 and is positioned in the same manner in the opening 20. In FIG. 12 the holder is shown with the cover 29 removed, but the bottoms of the slots 32 and 33 in the cover 29 are indicated by broken lines at 54 and 55.

The operation of the support embodying the invention will now be described. As shown in FIG. 1, the fluorescent tube 12 is inserted by horizontal sideways movement into a position below the metal casing 14, so that the pins 13 move sideways into an entry space 60 between the entrance to the openings 19 and 20 of the holder 50, and the underside of the casing 14. The entry space 60 is defined between the upper surface 26 of the second body 25, and the undersurface of the metal casing 14.

At the position shown in FIG. 1, the weight of the fluorescent tube 12 can be rested temporarily by placing the contact pins 13 thereof on a support means of the holder 15 before contact is made by the pins 13 with the electrical terminals 12 and 22. Conveniently the support means may be provided by a support surface such as the upper face 26 of the second body 25 of the holding structure 18. This gives the convenience that the fluorescent tube can be temporarily lodged approximately in position, while the exact adjustment of the position of the pins is made.

The final step is that the pins 13 are moved into the downwardly tapering entrance portions of the openings 19 and 20 and the fluorescent tube is then moved downwardly so that the contact pins 13 move into secure engagement with the U-shaped spring members 21 and 22, at the lower concave portions 51. In this position each pin 13 rests on the base portions 54 and 55 of the cover 29. The downward movement of the contact pins 13 is indicated by arrows 61 in FIGS. 3 and 5. When the light tube is in place, the curved third member 28 conceals metal end cap of the fluorescent tube.

An advantage of the present invention in its preferred form is that during installation the fluorescent lamp can be rested temporarily on a support surface so that the weight can be taken from the operator, while the operator manoeuvres the fluorescent tube into position, so that the contact pins of the tube are brought into alignment with the entrances to the openings containing the electrical contacts.

I claim:

1. A support for an elongate light tube having at each end a pair of projecting electrical contact pins, the support comprising:

an elongate frame; and first and second holders depending from the frame and positioned at respective ends of the elongate frame;

each holder having a holding structure which defines upwardly facing openings for receiving the contact pins of the light tube, each holder having electrical terminals located respectively in the region of the openings for contacting the pins of the light tube;

each said holding structure comprising a first body extending downwardly from the elongate frame and a second body which is spaced from the frame and projects from the first body in an inward direction generally along the direction of the elongate frame away from said end of the elongate frame, said second body having an upper face which faces towards the underside of the elongate frame, said upwardly facing openings being formed in the upper face of the second body;

said first body, said upper face of said second body, and the underside of said elongate frame defining together an entry space between the entrance to the openings and the elongate frame, said entry space extending without obstruction between said upper face of said second body and the underside of said elongate frame;

said upper face of said second body providing support means spaced from the underside of the elongate frame without obstruction therebetween for supporting said light tube temporarily by the pins thereof during installation before contact is made by the pins with said electrical terminals, whereby the light tube can be installed in the support by sideways movement of the pins into the respective entry space, followed by temporary support of the light tube by the pins thereof on the support means, followed by downward movement of the pins into the respective openings leading to the electrical terminals;

said second body having an inward face which faces in said inward direction, said holding structure including a third body positioned at a distal end of the second body and projecting from the bottom of said inward face of the second body in said inward direction, the third body being a curved arcuate body forming a cap for concealing the underside of the end of a light tube mounted on the support.

2. A support according to claim 1 in which the upwardly facing openings defined by the holding structure are tapered over at least part of their length, with the width of the opening decreasing in a downward direction.

3. Apparatus according to claim 1 in which each said electrical terminal comprises a generally U-shaped spring member positioned in a respective one of said upwardly facing openings with the open end of the U aligned with the entrance to the opening so as to receive in the U-shaped spring member a contact pin pushed downwardly into the said opening.

4. A support according to claim 1 in which said openings comprising slots extending downwardly in said second body, said slots extending also in said inward direction to open also at the said inward face of the second body, whereby said terminals can be inserted into the openings through said inward face of the second body, each holder including a removable cover positioned across said inward face of the second body, said removable cover including slots corresponding to the slots in the second body to allow movement of the pins of the fluorescent tube into contact with the U-shaped spring terminals.

5. A method of installing an elongate light tube having at each end a pair of projecting electrical contact pins, in a support comprising an elongate frame, first and second holders depending from the frame and spaced apart at respective ends of the elongate frame, each holder having a holding structure which defines upwardly facing openings for receiving the contact pins of the light tube, and each holder having electrical terminals located in the region of the openings for contacting the pins of the fluorescent tube, each said holding structure comprising a first body extending downwardly from the elongate frame and a second body which is spaced from the frame and projects from the first body in an inward direction generally along the direction of the elongate frame away from said end of the elongate frame, said second body having an upper face which faces towards the underside of the elongate frame, said upwardly facing openings being formed in the upper face of the second body; said first body, said upper face of said second body, and the underside of said elongate frame defining together an entry space between the entrance to the openings and the elongate frame, said entry space extending without obstruction between said upper face of said second body and the underside of said elongate frame; said upper face of said second body providing support means spaced from the underside of the elongate frame without obstruction therebetween for supporting said light tube temporarily by the pins thereof during installation before contact is made by the pins with said electrical terminals, said second body having an inward face which faces in said inward direction, said holding structure including a third body positioned at a distal end of the second body and projecting from the bottom of said inward face of the second body in said inward direction, the third body being a curved arcuate body forming a cap for concealing the underside of the end of a light tube mounted on the support;

the method including the steps of:

moving the elongate light tube in a sideways movement transverse to the length of the elongate frame, so as to move the contact pins of the light tube into said entry space defined between the entrance to the openings and elongate frame;

resting the light tube by placing the contact pins thereof on said support means to support the tube temporarily by the pins thereof before contact is made by the pins with the electrical terminals;

aligning the contact pins with the openings; and moving the light tube downwardly so as to produce downward movement of the pins into the said openings until the pins make electrical contact with said electrical terminals of the holders.

* * * * *